United States Patent [19]

Owen

[11] Patent Number: 4,987,836

[45] Date of Patent: Jan. 29, 1991

[54] SAFES

[76] Inventor: John S. Owen, 3 Jane Lane, Klippoortjie, Transvaal, South Africa

[21] Appl. No.: 431,635

[22] Filed: Nov. 3, 1989

[30] Foreign Application Priority Data

Nov. 4, 1988 [ZA] South Africa ..... 88/8272

[51] Int. Cl.[5] ..... E05B 65/52

[52] U.S. Cl. ..... 109/52; 70/63

[58] Field of Search ..... 109/49, 50, 51, 52, 109/58; 70/63, 158–162

[56] References Cited

U.S. PATENT DOCUMENTS

| | | | |
|---|---|---|---|
| 3,146,739 | 9/1964 | Furman | 109/52 |
| 4,051,790 | 10/1977 | Meditz | 109/58 |
| 4,474,116 | 10/1984 | Castenada | 109/51 |
| 4,493,268 | 1/1985 | Sidler | 109/52 |
| 4,577,563 | 3/1986 | Sidler | 109/52 |

*Primary Examiner*—Robert L. Wolfe

*Attorney, Agent, or Firm*—Werner & Bretschneider

[57] ABSTRACT

A readily portable safe is bracketed to a bracket plate adapted to be secured to a solid surface by relative sliding motion. The safe is in two parts hinged together. A cylinder lock has a bolt which engages in registering holes in lugs on the plate and the two parts of the safe.

7 Claims, 2 Drawing Sheets

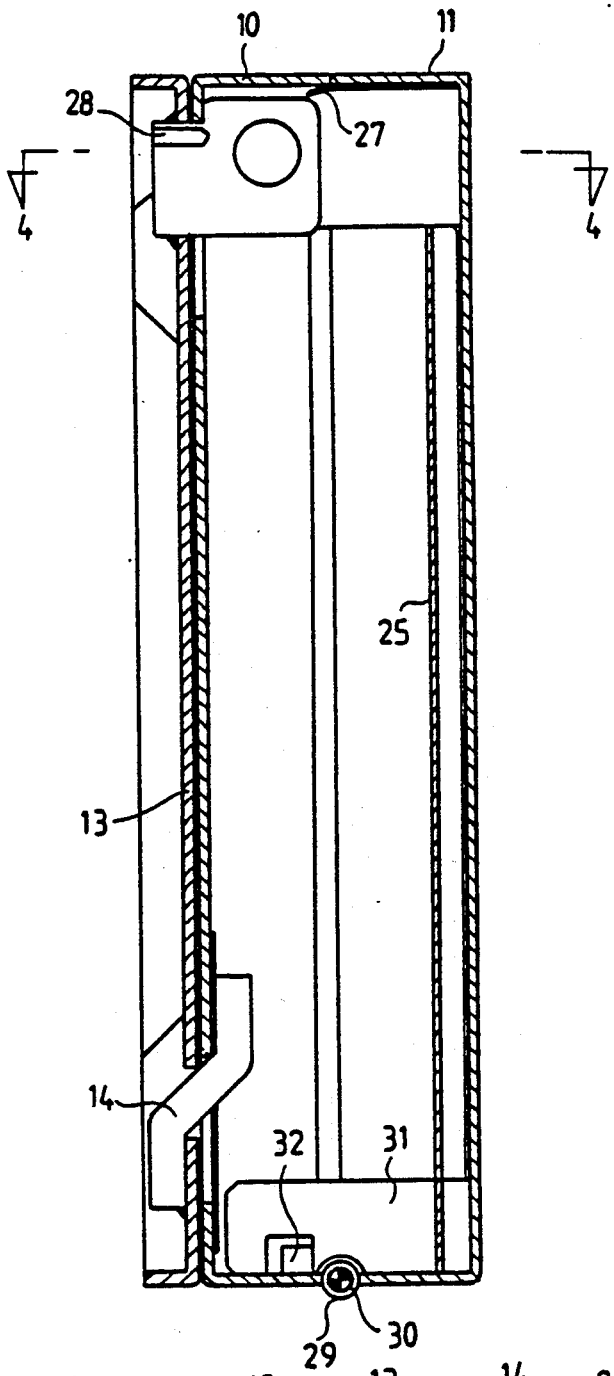
FIG 3
FIG 4
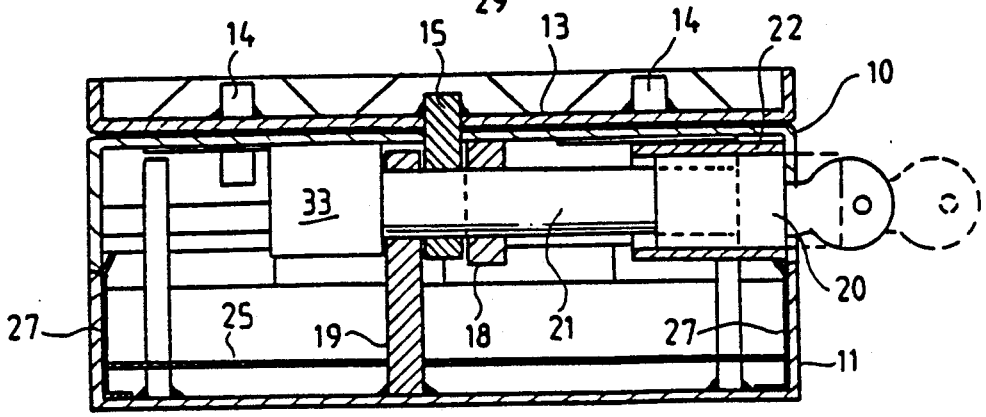

SAFES

BACKGROUND TO THE INVENTION

This invention relates to safes used for the safekeeping of valuable articles and particularly individual hand guns.

The safekeeping of hand guns has always been a problem for the owner. If not carried on the person, the firearm is either locked away out of reach and therefore unobtainable in an emergency or it is placed handily for use, with little or not regard to its safekeeping, e.g. in a bedside drawer, under a pillow or mattress, in the glove box of a motor car, etc. Many firearm owners that have fixed safes often remove the firearm at night in order that it may be more readily available during a night time emergency, but in the rush of the morning neglect to replace the firearm back in its safe. The firearm in such instances often finds its way into the hands of children or domestic employees, with often tragic results.

SUMMARY OF THE INVENTION

This invention provides the combination of a readily portable safe and a bracket plate comprising a bracket plate adapted to be secured to a solid surface, hooked lugs projecting from the plate, a safe lid having a base formed with slots adapted to pass over the lugs and on relative sliding movement engaging with the lugs to hold the base against the plate, a body hinged to the lid, formations on the body and lid with holes which register with a hole in one of the lugs on closure of the lid, and a lock having a bolt to engage with the registering holes to lock the lid and the body together and to lock the base against the sliding movement in the direction for unbracketing the safe.

The lock is preferably a sliding cylinder lock carrying a bolt and is fitted to the body.

The body may be fitted with a stop against which the bolt abuts on locking and which stop guards the bolt.

The lid and the body may be hinged back-flap fashion by means of a pin and sleeves on the lid and the body and the body may have secured to it at least one notched bracket extending into the lid and the lid on its inside may carry a formation engaging in the notch when the lid is closed so that with the safe locked the lid is held against separation from the body even in the absence of the hinge pin.

DESCRIPTION OF THE DRAWINGS

FIG. 3 is a section through a closed safe and bracket plate assembly, and

FIG. 4 is a section on the line 4—4 in FIG. 3.

DESCRIPTION OF EMBODIMENTS

Figure 1:
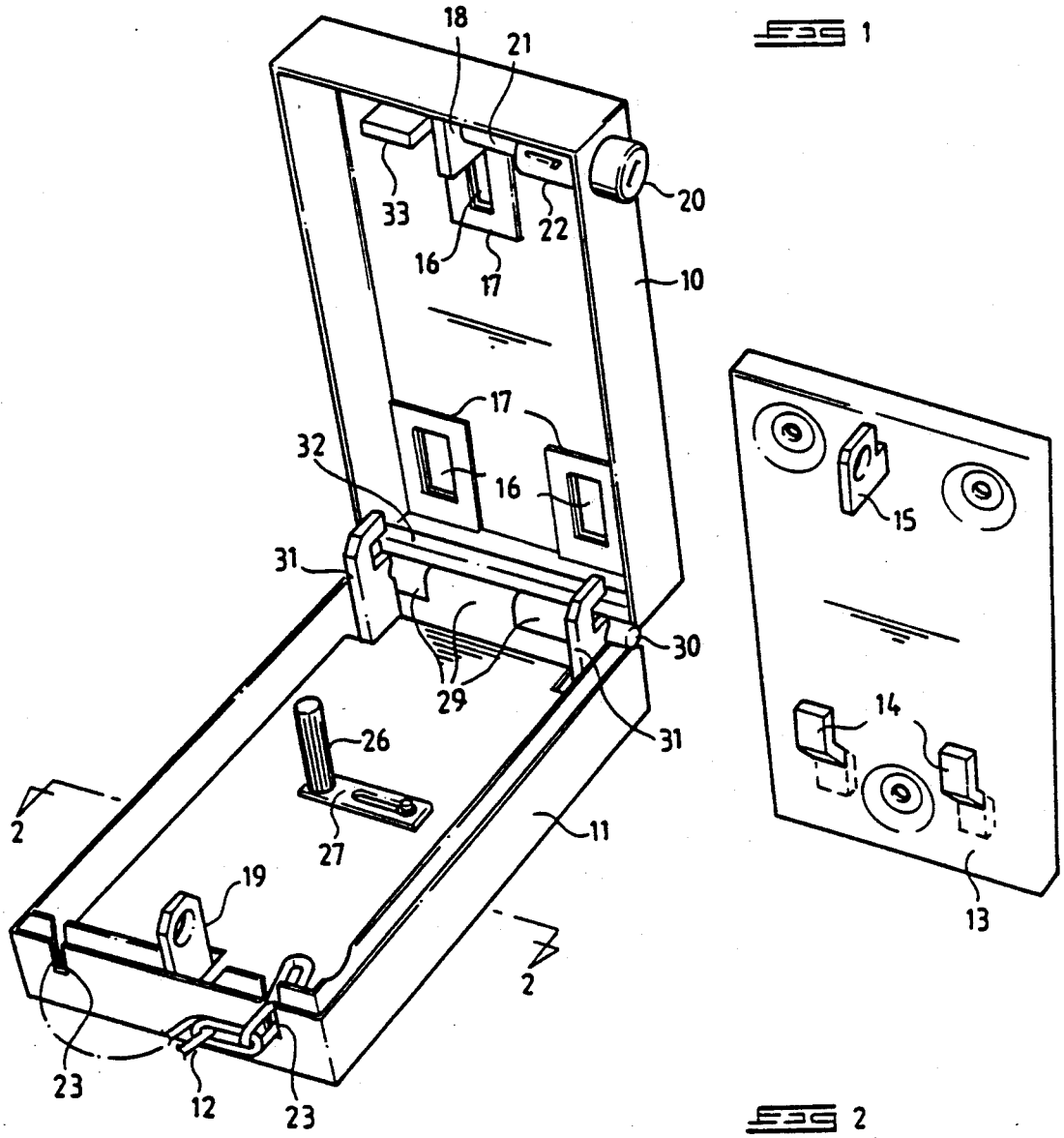
FIG. 1 is a perspective view of an open safe and its associated bracket plate.
Figure 2:
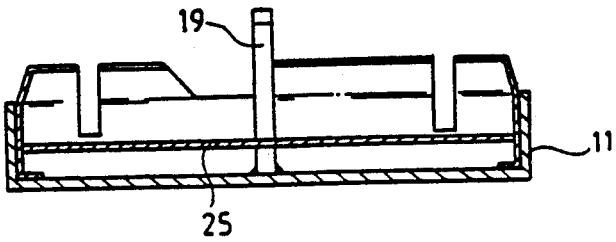
FIG. 2 is a section on the line 2—2 in FIG. 1.

The safe shown in the drawings has a lid 10 and a body 11 each of open-topped box shaped hinged together. This safe is of a size that is readily portable, e.g. 260 mm ×150 mm ×60mm.

The safe is used in combination with one or more bracket plates such as the bracket plate 13 shown in the drawings. On the plate 13 there are locating lugs 14 and 15. Slots 16 in the lid fit over the lugs 14 and 15 and by sliding the lid down (in FIG. 3) the lid is bracketed to the plate due to the fact that hooks on the lugs engage with the thickness of the lid. Around the slots patches 17 of spring steel strip are applied to strengthen the lid against being pried off the plate 13.

The lug 15 is holed and the hole is in register with a hole in a bracket 18 on the lid 10 when the lid is bracketed to the plate 13. Both holes are in register with a hole in a post 19 on the body 11 when the safe is closed.

A cylinder lock 20 with a bolt 21 can slide in a sleeve 22 secured to the lid 10. With the cylinder 20 in its locked position, the bolt 21 passed through the holes in the parts 15, 18 and 19, thus locking the lid 10 to the bracket 13 and the body 11 to the lid 10. On unlocking the cylinder 20 is withdrawn to withdraw the bolt 21 from the holes. The safe may now be opened by hinging the body 11 away from the lid 10. The latter will still remain bracketed to the plate 13, but if desired it may be removed by relative sliding movement to disengage the lid from the lugs and by drawing the lid off the plate 13.

In use the plate 13 may be mounted on any suitable surface such as against a wall, under a table or under a rigid shelf. It may also be mounted on the body of a vehicle. In practice a safe would be used in combination with a plurality of plates 13 installed at suitable locations. The plate 13 will generally be affixed to a surface by means of steel bolts, the heads of which are covered by the safe when locked in position, preventing removal of the safe and plate 13.

For the occasion on which a plate 13 is not available the body 11 is formed with two slots 23 into which a pair of links of a hardened chain 12 may be fitted as in shown in FIG. 1. The chain 12 may be passed around a post or other rigid object to secure the safe in position. The chain 23 may also be used for carrying the safe.

The body 11 has a false floor 25 which is spaced from the body floor. A post 26 carried by a pivoted slide 27 projects from the false floor 25. The post 26 is designed to pass through the trigger guard of a hand gun, to prevent the gun from being removed through a side of the safe, should the safe be forced. A layer of a sponge material contained within the lid 10 and body 11 of the safe may be used to cushion the contents, e.g. a hand gun, against damage and also to hold the false floor 25 in place. The false floor makes it difficult for an intending safe breaker to get into the safe through the floor of the body 10 by means of a device such as an angle grinder. As a safeguard against entry from the sides the walls of the body 11 are lined with spring steel strips 27.

In order to protect the lug 15 against attack from the side, it has a hardened steel pin 28 sunk into its thickness.

The body 11 is hinged to the lid 10 back-flap fashion by means of a hinge formed by sleeves 29 welded to the body and lid and a hinge pin 30 passing through the sleeves 29. To safeguard the safe against removal of the pin 30 the body 11 carries a pair of notched brackets 31 and the back wall of the lid 10 is fitted with a rail 32 that engages in the notches. When the safe is locked, the body 11 cannot be separated from the lid 10 even if the in 30 is no longer there.

A stop 33 on the lid limits travel of the bolt 21 and guards against it being knocked out from the side.

I claim:

1. The combination of a readily portable safe and a bracket plate comprising a bracket plate adapted to be secured to a solid surface, hooked lugs projecting from the plate, a safe body having a base formed with slots adapted to pass over the lugs and on relative sliding movement engaging with the lugs to hold the base against the plate, a lid hinged to the body, formations on the body and lid with holes which register with a hole in one of the lugs on closure of the lid, and a lock having a bolt to engage with the registering holes to lock the lid and the body together and to lock the base against sliding movement in the direction for unbracketing the safe.

2. The combination claimed in claim 1 in which the lock is a sliding cylinder lock carrying a bolt and if fitted to the body.

3. The combination claimed in claim 2 in which the body is fitted with a stop against which the bolt abuts on locking and which stop guards the bolt.

4. The combination claimed in claim 1 in which the lid and the body are hinged back-flap fashion by means of a pin and sleeves on the lid and the body and in which the body has secured to it at least one notched bracket extending into the lid and the lid on its inside carries a formation engaging in the notch when the lid is closed so that with the safe locked the lid is held against separation from the body even in the absence of the hinge pin.

5. The combination claimed in claim 4 in which the lid has a false lining of sheet spring steel loosely positioned and spaced from the lid.

6. The combination claimed in claim 5 in which the lid has sides which are faces with linings of spring steel.

7. The combination claimed in claim 1 which the body has a side formed with a pair of notches to be engaged by a hardened steel chain which is held captive in the notches by the lid.

* * * * *